US010071573B2

(12) United States Patent
Matsuda

(10) Patent No.: US 10,071,573 B2
(45) **Date of Patent: *Sep. 11, 2018**

(54) SHEET PROCESSING APPARATUS

(71) Applicant: TOSHIBA TEC KABUSHIKI KAISHA, Tokyo (JP)

(72) Inventor: Okiharu Matsuda, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 22 days.

This patent is subject to a terminal disclaimer.

(21) Appl. No.: 15/455,472

(22) Filed: Mar. 10, 2017

(65) Prior Publication Data

US 2017/0182808 A1 Jun. 29, 2017

Related U.S. Application Data

(62) Division of application No. 14/797,880, filed on Jul. 13, 2015, now Pat. No. 9,623,673.

(51) Int. Cl.
*B41J 11/70* (2006.01)
*B41J 2/325* (2006.01)

(52) U.S. Cl.
CPC ..... *B41J 11/70* (2013.01); *B41J 2/325* (2013.01)

(58) Field of Classification Search
CPC ..... B41J 11/70; B41J 2/325
See application file for complete search history.

(56) References Cited

U.S. PATENT DOCUMENTS

| | | | | |
|---|---|---|---|---|
| 5,737,005 | A | 4/1998 | Sawano et al. | |
| 9,623,673 | B2 * | 4/2017 | Matsuda | B41J 2/325 |
| 2009/0046136 | A1 | 2/2009 | Choi et al. | |

FOREIGN PATENT DOCUMENTS

| | | | |
|---|---|---|---|
| JP | 59225965 | | 12/1984 |
| JP | H11277777 | A | 10/1999 |
| JP | 2008006687 | | 1/2008 |
| JP | 2008006688 | A | 1/2008 |

* cited by examiner

*Primary Examiner* — Lamson Nguyen
(74) *Attorney, Agent, or Firm* — Patterson & Sheridan, LLP

(57) ABSTRACT

A sheet processing apparatus includes a sheet conveying unit configured to unwind a portion of a rolled sheet and convey the unwound sheet, a ribbon conveying unit configured to convey a ribbon having thereon a coloring layer that is not visible up to a predetermined temperature and becomes visible above the predetermined temperature, a thermal head configured to transfer the coloring layer on the ribbon to a portion of the unwound sheet, and a cutter configured to cut off a portion of the unwound sheet.

9 Claims, 11 Drawing Sheets

| BLACK MARK | DECOLORABLE LAYER POSITION/SIZE | PAPER SIZE |
|---|---|---|
| B1 | COLORABLE/DECOLORABLE PRINTING LAYER S IN ENTIRE LEFT HALF REGION OF SHEET | A4 |
| B2 | COLORABLE/DECOLORABLE PRINTING LAYER S IN UPPER HALF OF LEFT HALF OF SHEET | A4 |
| B3 | COLORABLE/DECOLORABLE PRINTING LAYER S IN ENTIRE REGION OF SHEET | A4 |

SHEET PROCESSING APPARATUS

CROSS-REFERENCE TO RELATED APPLICATION

This application is a division of U.S. patent application Ser. No. 14/797,880, filed on Jul. 13, 2015, the entire contents of which are incorporated herein by reference.

FIELD

Embodiments described herein relate generally to a sheet processing apparatus that prepares a sheet on which an image is to be printed using a thermal head.

BACKGROUND

In the related art, a printer forms an image using a coloring layer (leuco layer) formed on a sheet. The image can be formed on the sheet by heating the coloring layer, and the image can be erased by additionally heating the coloring layer. Since the image can be erased from the sheet, the sheet can be recycled many times for printing. One type of such a printer uses sheets that have the coloring layer formed on the entire region thereof. The sheets are usually fixed size and stored in a sheet storage unit of the printer, and the printer takes the sheets one by one for printing. However, the images are not necessarily formed in the entire region of the sheets. When the images are formed only on a specific portion of the sheets, the coloring layer on the other region of the sheets may be wasted.

DETAILED DESCRIPTION

One or more of the embodiments provide a printer that can perform printing on printing medium of any sizes.

In general, according to one embodiment, a sheet processing apparatus includes a sheet conveying unit configured to unwind a portion of a rolled sheet and convey the unwound sheet, a ribbon conveying unit configured to convey a ribbon having thereon a coloring layer that is not visible up to a predetermined temperature and becomes visible above the predetermined temperature, a thermal head configured to transfer the coloring layer on the ribbon to a portion of the unwound sheet, and a cutter configured to cut off a portion of the unwound sheet.

First Embodiment

Hereinafter, a printer according to a first embodiment will be described in detail with reference to the drawings.

Figure 1:
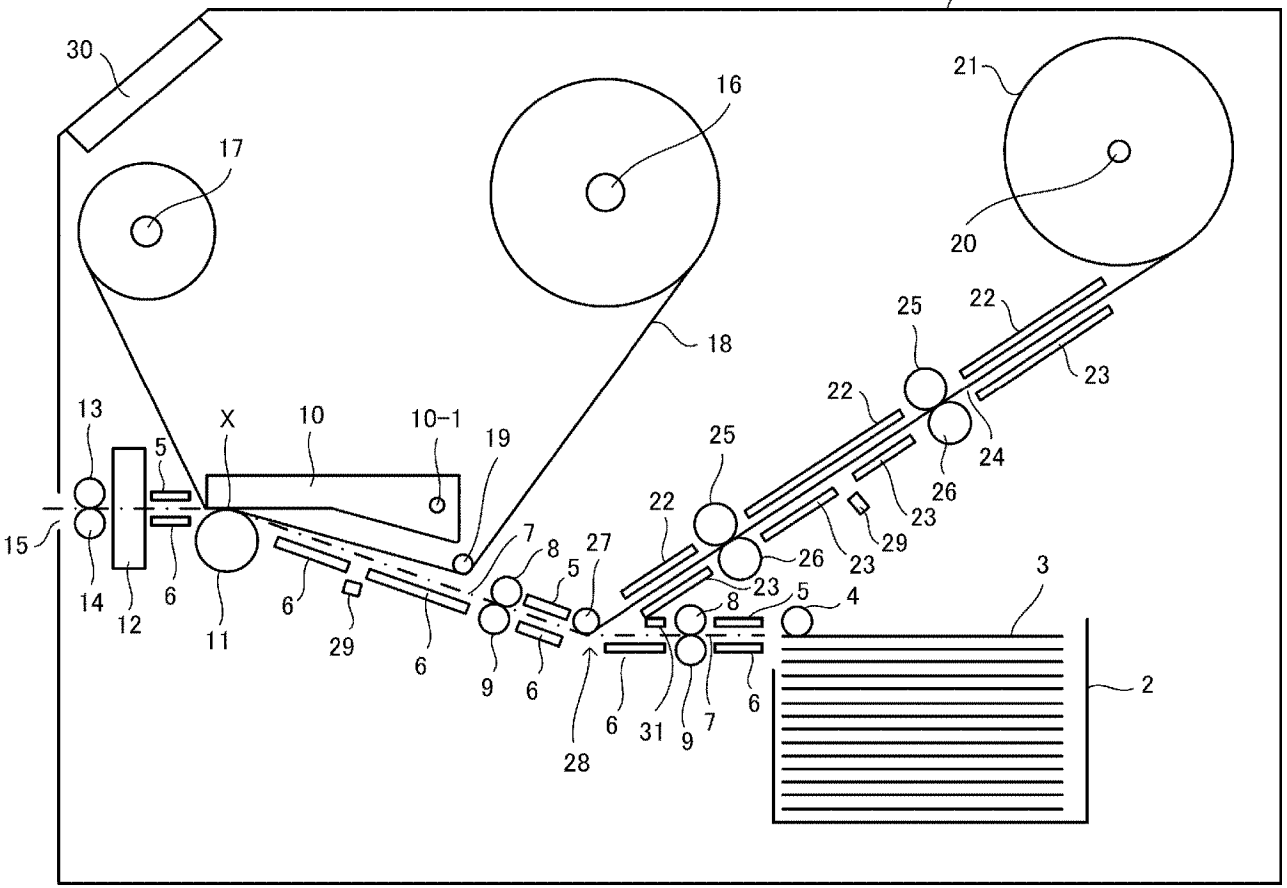
FIG. 1 illustrates main components of a printer according to a first embodiment.

FIG. 1 illustrates main components of the printer according to the first embodiment.

A printer 1 includes a cut-off sheet holder 2 on a rear side thereof, and cut-off sheets 3 are stacked and held in the cut-off sheet holder 2. The cut-off sheet 3 includes a layer called a leuco layer with which coloring and decoloring is performed by heating on the entire front surface thereof. In a description of the embodiment, since a printing medium used in the printer 1 is transported from the right side to the left side, in FIG. 1, the right side is described as an upstream side and the left side is described as a downstream side.

A delivery roller 4 is provided on an upper side of the cut-off sheet holder 2 so as to transport the cut-off sheets 3, which are stacked and stored, sequentially from the uppermost cut-off sheet 3 to the outside of the cut-off sheet holder 2.

A first upper transport guide 5 and a first lower transport guide 6 are disposed between the delivery roller 4 and a discharge slit 15 that is provided on the most downstream side of the printer 1. A first paper transport path 7 is formed between the first upper transport guide 5 and the first lower transport guide 6 and the cut-off sheet 3 or the roll paper 21 (described below) is transported through the first paper transport path 7.

A feed roller 8 and an idler roller 9 are disposed to face each other on the downstream side of the delivery roller 4. The feed roller 8 is rotatable by a motor (not illustrated) and the idler roller 9 is disposed opposite to the feed roller 8 across the first paper transport path 7. The feed roller 8 and the idler roller 9 are set to be a pair such that the cut-off sheet 3 or the roll paper 21 is nipped therebetween and is transported. A plurality of pairs of the feed rollers 8 and the idler rollers 9 is provided along the first paper transport path 7.

In addition, a thermal head 10 and a platen roller 11 are disposed to face each other across the first paper transport path 7. The thermal head 10 includes a rotating shaft 10-1, is rotatable about the rotating shaft 10-1, and thus may be moved between a position at which the thermal head 10 is in contact with and pressed against the platen roller 11 and a position at which the thermal head 10 is apart from the platen roller 11.

A cutter 12 is provided on the downstream side of the thermal head 10 and cuts the roll paper 21 (described below). A discharge roller 13 and a discharge idler roller 14 are provided to face each other across the first paper transport path 7 on the downstream side of the cutter 12. The roll paper 21 cut off by the cutter 12 or the cut-off sheet 3 that is passing through the cutter 12 without being cut off by the cutter 12 is discharged from the discharge slit 15 provided on the downstream side of the discharge roller 13 to the outside of the printer 1 in cooperation of the discharge roller 13 with the discharge idler roller 14.

Figure 2:
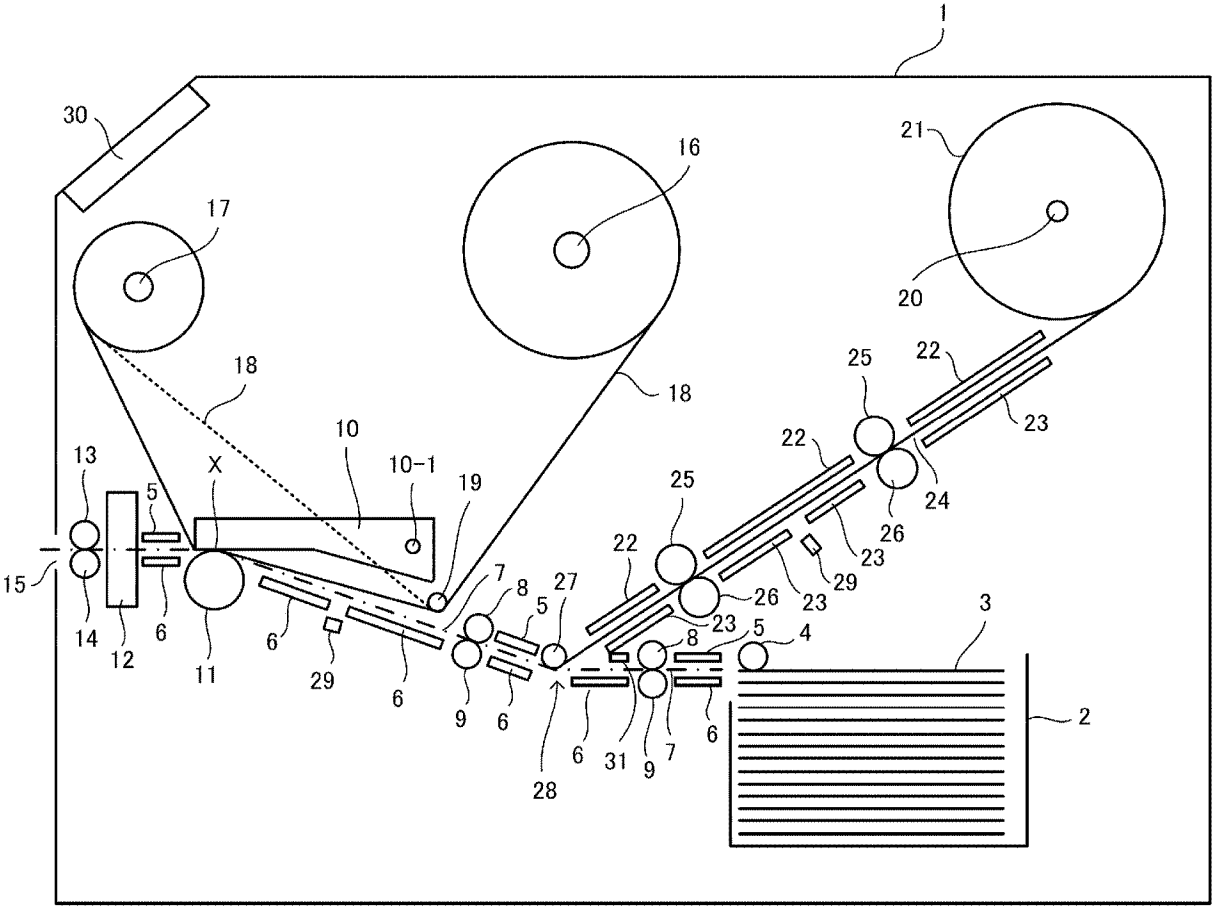
FIG. 2 illustrates the main components of the printer according to the first embodiment when a decoloring ribbon does not pass a thermal head.

In addition, a decoloring ribbon 18 is provided in the printer 1. The decoloring ribbon 18 is wound around a ribbon unwinding roller 16, and the decoloring ribbon 18 unwound from the ribbon unwinding roller 16 is stretched over to a ribbon collecting roller 17 through a ribbon tension roller 19 and a point X where the thermal head 10 is into contact with the platen roller 11. The printer 1 includes a ribbon retracting mechanism (not illustrated). Thus, in a ribbon retraction state, as illustrated by a dot line in FIG. 2, the decoloring ribbon 18 unwound from the ribbon unwinding roller 16 is stretched over to the ribbon collecting roller 17 only through the ribbon tension roller 19.

In addition, the roll paper 21 wound around a winding shaft 20 is provided rotatably on the upper side of the cut-off sheet holder 2. A second upper transport guide 22 and a second lower transport guide 23 are provided between the roll paper 21 and a joining section 28 with the first paper transport path. A second paper transport path 24 is formed between the second upper transport guide 22 and the second lower transport guide 23, and the roll paper 21 is transported through the second paper transport path 24. In addition, feed rollers 25 and idler rollers 26 are disposed to face each other along the second paper transport path 24. The feed roller 25 is rotatable by a motor (not illustrated) and the idler roller 26 is disposed opposite to the feed roller 25 across the second paper transport path 24. The feed roller 25 and the idler roller 26 are set to be a pair such that the roll paper 21 is nipped therebetween and is transported. A plurality of pairs of the feed rollers 25 and the idler rollers 26 is provided along the second paper transport path 24. In addition, an idler roller 27 is provided at the joining section 28 in order for the roll paper 21 which is transported from the second paper transport path 24 toward the first paper transport path 7 to be conveyed smoothly to the first paper transport path 7 at the joining section 28.

In addition, a plurality of paper sensors 29 that detect transported positions of the cut-off sheet 3 and the roll paper 21 is provided along the first paper transport path 7 and the second paper transport path 24.

In addition, a display unit 30 that displays various operational states and the like of the printer 1 is provided above the discharge slit 15 in the printer 1.

Figure 3:
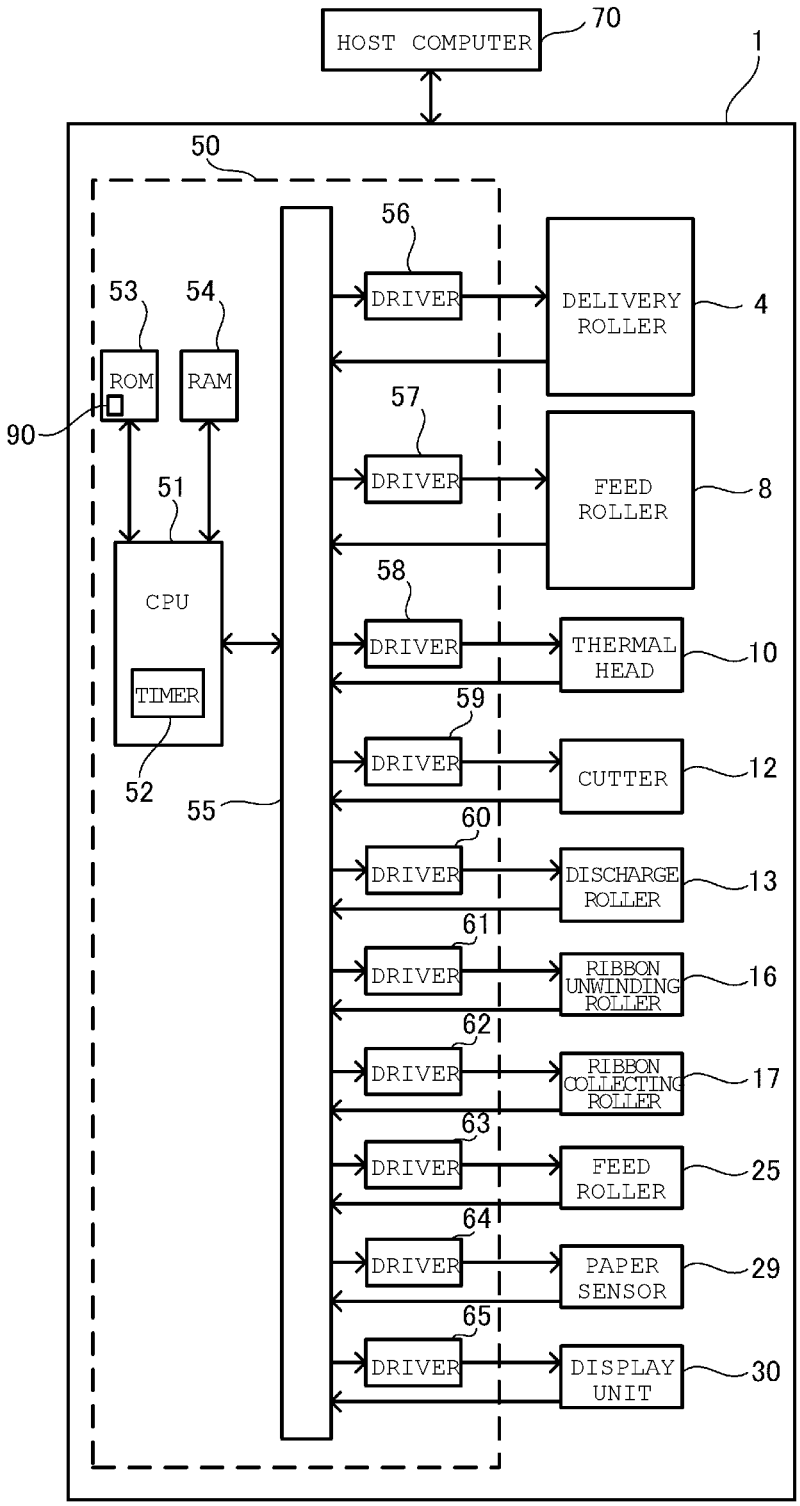
FIG. 3 is a block diagram of the printer according to the first embodiment.
Figure 4:
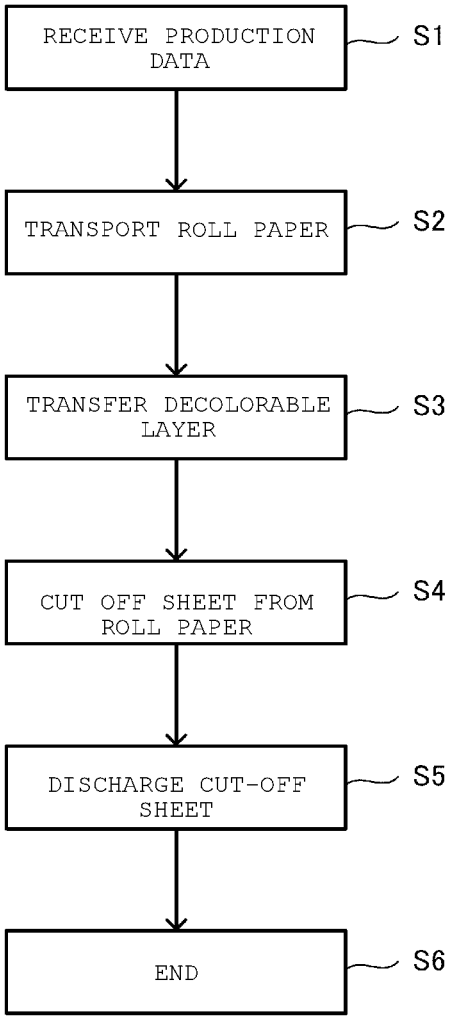
FIG. 4 is a flowchart illustrating a process of producing a cut-off sheet carried out by the printer according to the first embodiment.

FIG. 3 is a block diagram of a control circuit of the printer 1 according to the embodiment. The controller 50 performs control of transportation of paper, printing, erasing of the printed image, and transferring of an decoloring ribbon, cutting of paper, discharge of a sheet, unwinding of an decoloring ribbon, collection of a transferred decoloring ribbon, detection of a paper position, and a display of an operational state of the printer 1.

The controller 50 performs communication with a host computer 70 and various types of control and includes a microcomputer.

According to a program, a microprocessor unit (MPU) 51 of the controller 50 performs various types of control or arithmetic operations, such as sheet transport control, control of printing, erasing of the printed image, and control of transferring of an decoloring ribbon, sheet cutting control, sheet discharge control, unwinding control of an decoloring ribbon, transferred decoloring ribbon collecting control, paper position detecting control, and printer state displaying control.

In addition, the MPU 51 includes a timer 52 as a unit that is used to perform setting and control of time.

A ROM 53 and a RAM 54 are disposed, in the controller 50, as main memory units that store a control program that is executed by the MPU 51, data that is obtained during control or arithmetic operation, or the like.

The ROM 53 is a read only memory that includes the control program, a table, or the like, and the RAM 54 is a random access memory that stores data that is obtained during arithmetic operation, or the like.

In addition, a data analyzing portion 90 (illustrated below) is provided in the ROM 53. The data analyzing portion 90 analyzes print data and determines which printing medium is to be used.

An input/output unit (I/O) 55 is provided in the controller 50, and the I/O 55 performs reception of various input data items from the host computer 70 and transmission of control outputs from the controller 50 to the host computer 70. The I/O 55 is connected to the MPU 51, the ROM 53, and the RAM 54 through a bus.

As units that extract the control outputs, first, second, third, fourth, fifth, sixth, seventh, eighth, ninth, and tenth drivers 56, 57, 58, 59, 60, 61, 62, 63, 64, and 65 are connected to the I/O 55.

The first driver 56 supplies a drive output to the delivery roller 4. The second driver 57 supplies a drive output to the feed roller 8. The third driver 58 supplies a drive output to the thermal head 10. The fourth driver 59 supplies a drive output to the cutter 12. The fifth driver 60 supplies a drive output to the discharge roller 13. The sixth driver 61 supplies a drive output to the ribbon unwinding roller 16. The seventh driver 62 supplies a drive output to the ribbon collecting roller 17. The eighth driver 63 supplies a drive output to the feed roller 25. The ninth driver 64 supplies a drive output to the display unit 30.

Hereinafter, operations of the printer 1 are described with reference to FIGS. 1 to 6. In an initial state, the decoloring ribbon 18 unwound from the ribbon unwinding roller 16 is in a state (refer to FIG. 1) of being stretched over to the ribbon collecting roller 17 through the ribbon tension roller 19 and the point X where the thermal head 10 is in contact with the platen roller 11.

A user receives production data of the cut-off sheet 3 from the host computer 70 (S1). The controller 50 causes the feed roller 25 to rotate and to transport the roll paper 21 to the downstream side through the second paper transport path 24 in cooperation with the idler roller 26 (S2).

The roll paper 21 is transported to the downstream side through the second paper transport path 24 and eventually conveyed to the first paper transport path 7 at the joining section 28. The roll paper 21 is transported to the downstream side through the idler roller 27, and eventually the leading end thereof reaches the point X.

Then, the controller 50 causes the roll paper 21 to be transported and the thermal head 10 to be heated, and causes the decoloring ribbon 18 to be transferred to the roll paper 21 in accordance with the production data of the cut-off sheet 3 (S3), and then an decolorable layer is formed on the roll paper 21. During the transfer, the thermal head 10 is driven to be in a temperature range of about 300° C. to 500° C.

Then, the controller 50 drives the cutter 12 to cut the roll paper 21 (S4), and then, causes the cut-off sheet to be discharged from the discharge slit 15 to the outside of the printer 1 in cooperation of the discharge roller 13 with the discharge idler roller 14 (S5), and then production of the cut-off sheet 3 provided with a decolorable printing layer thereon ends (S6). In a case of producing a plurality of cut-off sheets 3, the transport (S2), the transferring of the decolorable layer (S3), and the cutting of paper (S4) are repeated.

Figure 5:
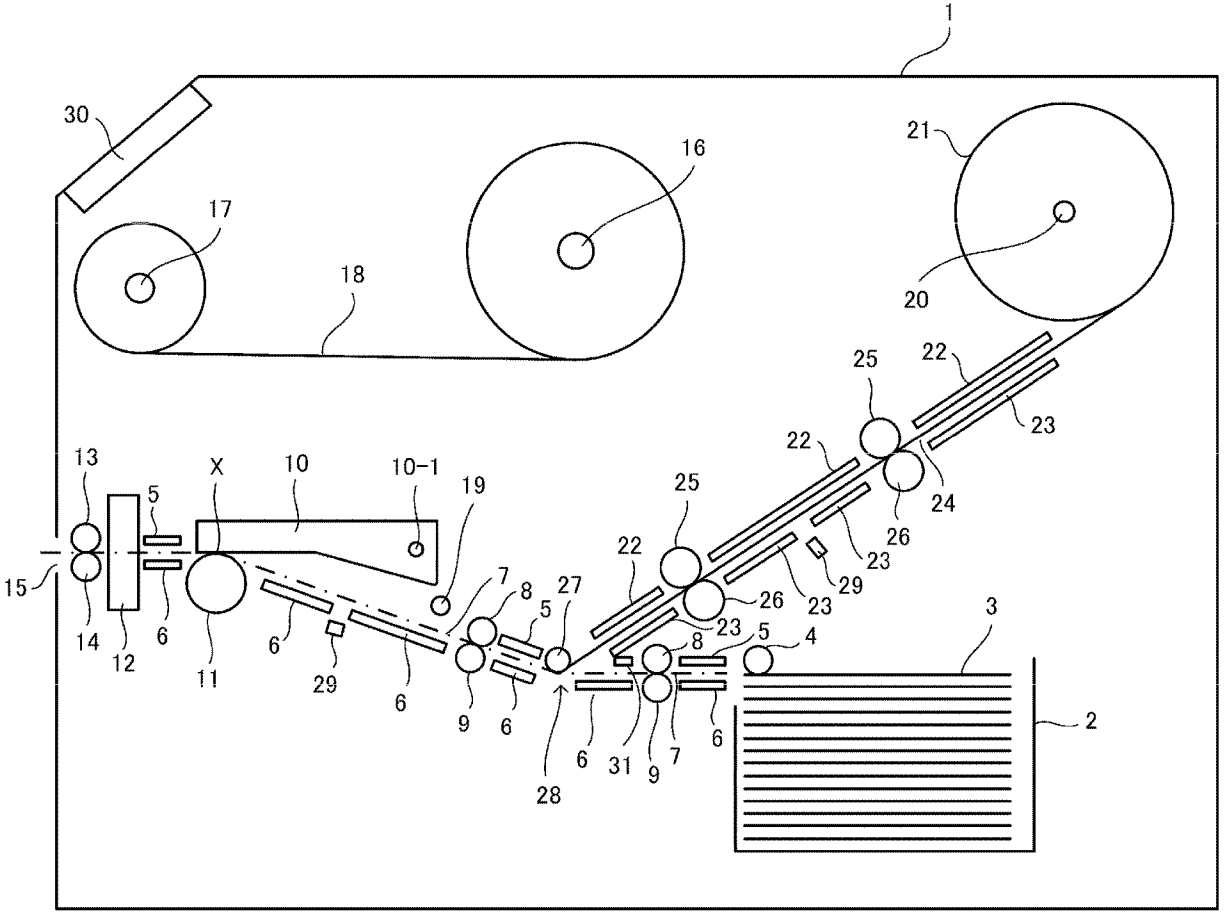
FIG. 5 illustrates the main components of the printer according to the first embodiment when a decoloring ribbon section is in a retracted position.
Figure 6:
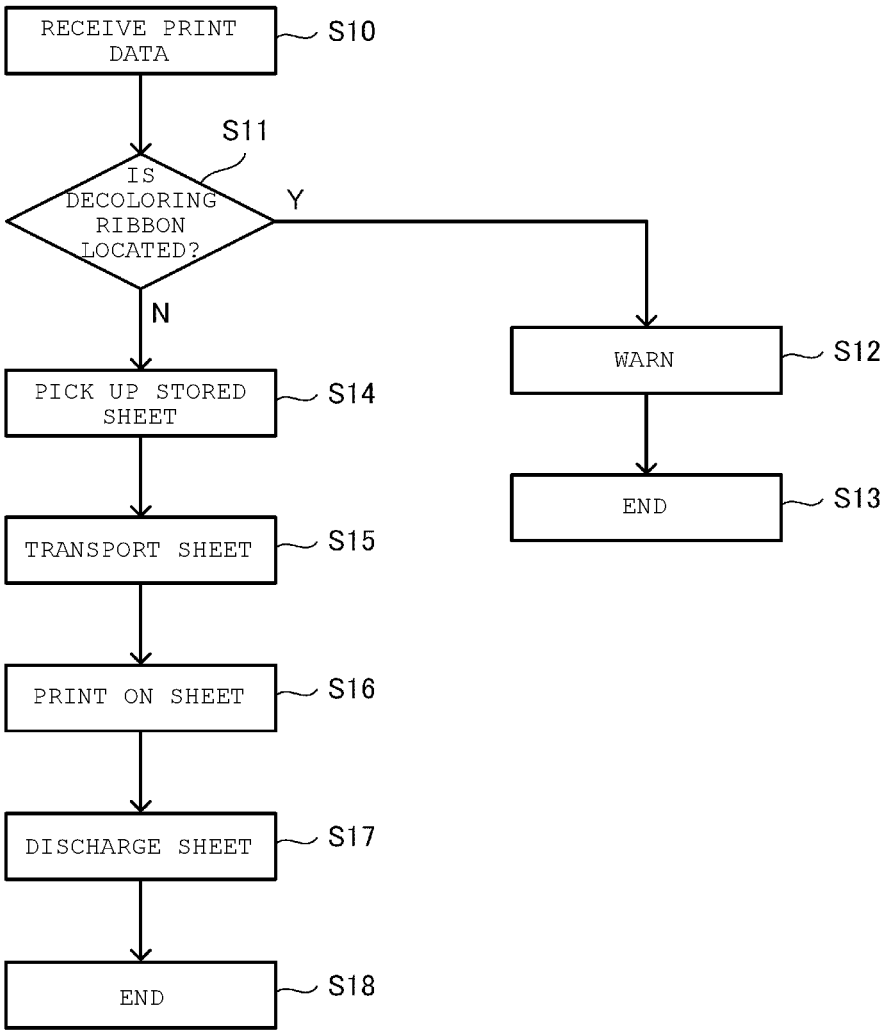
FIG. 6 is a flowchart illustrating a printing process on the cut-off sheet carried out by the printer according to the first embodiment.
Figure 7:
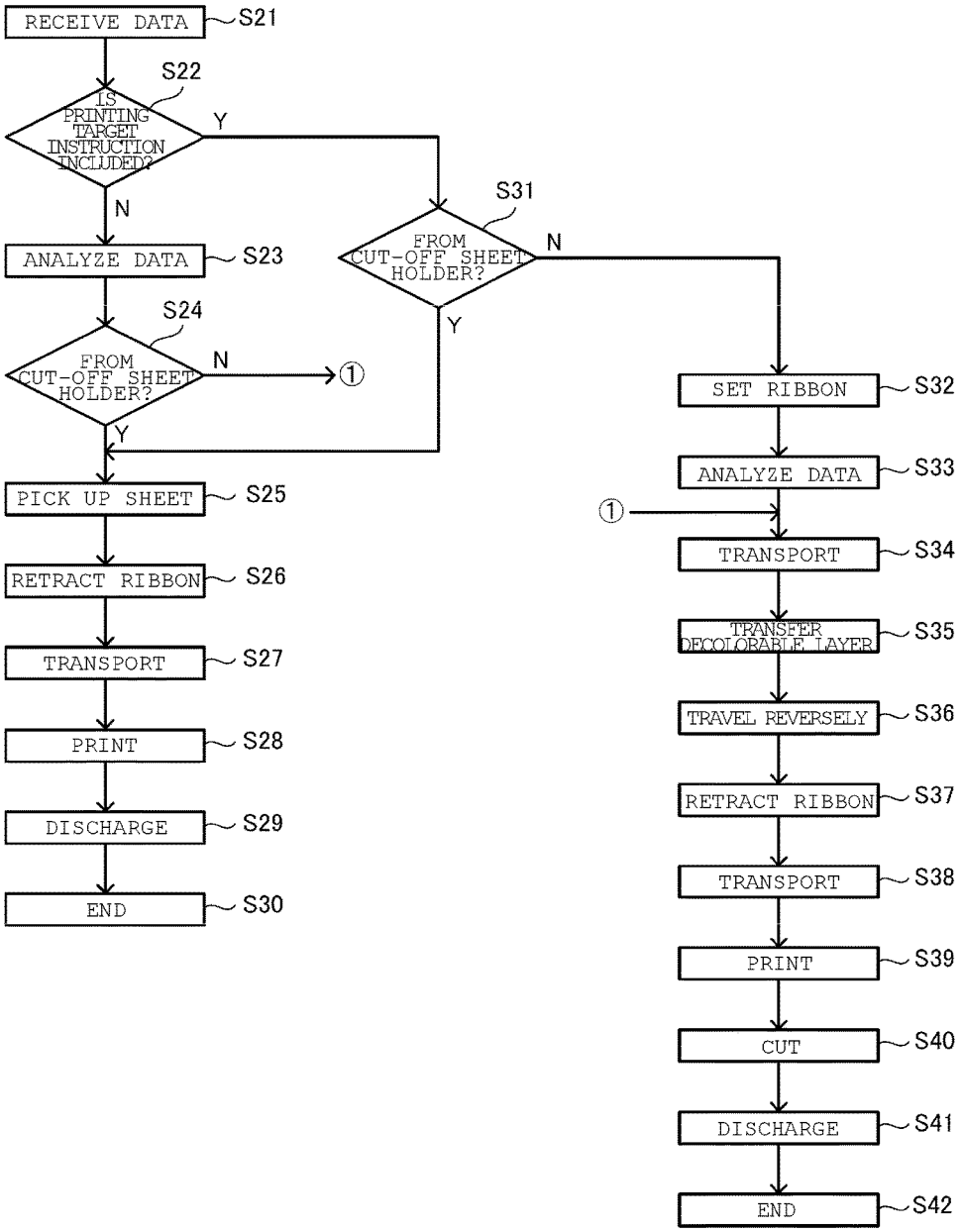
FIG. 7 is a flowchart illustrating a printing process carried out by a printer according to a second embodiment.

When the printing is performed on the cut-off sheet 3 provided with the decolorable printing layer, a user sets the cut-off sheet 3 in the cut-off sheet holder 2, detaches the decoloring ribbon 18 from the printer 1 once, and attaches the decoloring ribbon not to be located between the thermal head 10 and the platen roller 11 as illustrated in FIG. 5. When the printing is performed on the cut-off sheet 3 provided with the decolorable printing layer, the decoloring ribbon 18 may be removed from the printer 1 without being attached so as not to be located between the thermal head 10 and the platen roller 11 as illustrated in FIG. 5.

Here, the printer 1 receives print data from the host computer 70 (S10). At this time, the print data contains an instruction to perform printing on the cut-off sheet 3 placed in the cut-off sheet holder 2.

When the controller 50 receives the print data (S10), a decoloring ribbon sensor (not illustrated) detects whether the decoloring ribbon 18 is located between the thermal head 10 and the platen roller 11 (S11). Then, as illustrated in FIG. 1, when the decoloring ribbon 18 is located between the thermal head 10 and the platen roller 11 (Y in S11), the printing on the cut-off sheet 3 by the thermal head 10 may not be performed properly. Therefore, a warning to remove the decoloring ribbon 18 from the space between the thermal head 10 and the platen roller 11 is displayed on the display unit 30 (S12), and the process ends (S13).

When the decoloring ribbon 18 is not located between the thermal head 10 and the platen roller 11 (N in S11), the controller 50 rotates the delivery roller 4 to pick up the uppermost cut-off sheet 3 (S14), and the uppermost cut-off sheet 3 is transported to the downstream side through the first paper transport path 7 in cooperation of the feed roller 8 with the idler roller 9 (S15). When the cut-off sheet 3 reaches the point X, the thermal head 10 is electrified and performs printing on the cut-off sheets 3 sequentially (S16). During the printing, the thermal head 10 is driven to be in a temperature range of about 300° C. to 500° C. The printed cut-off sheet 3 is transported to the downstream side by the platen roller 11 and then discharged from the discharge slit 15 to the outside of the printer 1 in cooperation of the discharge roller 13 with the discharge idler roller 14 (S17), and the process ends (S18).

As described above, the printer 1 may produce the cut-off sheet 3 having any paper lengths and any decolorable layer sizes, and, thus, printing with the cut-off sheet 3 can be performed more cost-effectively relative to printing using a sheet having a fixed size.

Second Embodiment

Hereinafter, a printer 1 according to a second embodiment is described with reference to FIGS. 1-3 and FIG. 6. In the printer 1 according to the second embodiment, the process of transferring the decoloring ribbon 18 to the roll paper 21 and the production of the cut-off sheet 3 in advance before printing on the cut-off sheet 3 is not performed, but it is possible to perform immediate printing on the roll paper 21 in accordance with the transfer of a decoloring ribbon.

When print data is received from the host computer 70 (S21), the printer 1 determines whether or not a printing target instruction is included in the received print data. Since the printer 1 according to the second embodiment includes the cut-off sheet holder 2 and the roll paper 21, the printing target instruction in this case includes designation of one of the cut-off sheet holder 2 and the roll paper 21 or automatic determination.

The received print data is checked to determine whether or not the printing target instruction is included therein (S22). When there is no printing target instruction (N in S22), the print data is analyzed in the data analyzing portion 90 (S23). A position to be printed is determined through the analysis in the data analyzing portion 90 and it is determined whether the printing should be performed on the cut-off sheet 3 to which the decolorable printing layer is provided on the entire surface thereof or whether the decolorable printing layer should be formed on the roll paper 21 and then the printing should be performed on the position of the roll paper 21 where the decolorable printing layer is formed. In addition, an optimal position or size of the decolorable printing layer is determined.

When, based on the data analysis, it is determined that the printing should be performed on the cut-off sheet 3 to which the decolorable printing layer is formed on the entire surface thereof, that is, sheet feeding from the cut-off sheet holder 2 should be performed (Y in S24), the delivery roller 4 is caused to rotate and to pick up the uppermost cut-off sheet 3 (S25), and the cut-off sheet is transported through the first paper transport path 7. As described above, the decolorable printing layer is formed on the entire surface of the cut-off sheet 3. Thus, there is no need to provide a new decolorable printing layer to the cut-off sheet 3. Therefore, the uppermost cut-off sheet 3 is picked up (S25) and the decoloring ribbon 18 unwound from the ribbon unwinding roller 16 is stretched over to the ribbon collecting roller 17 only through the ribbon tension roller 19 by the ribbon retracting mechanism (not illustrated), that is, the decoloring ribbon 18 is retracted from the point X, which is the transferring position of the decoloring ribbon 18 (S26). The ribbon retracting mechanism includes the first paper transport path 7 that has a width twice or more as wide as widths of the decoloring ribbon 18 and the thermal head 10. During the transfer of the decoloring ribbon 18, the decoloring ribbon 18 is positioned to be in contact with the thermal head 10 at the point X as illustrated in FIG. 1, and at the time of ribbon retraction, the decoloring ribbon 18 is caused to move in a width direction of the roll paper and not to be nipped between the thermal head 10 and the platen roller 11. This state is the position of the decoloring ribbon 18 in FIG. 2.

Then, the controller 50 transports the picked-up cut-off sheet 3 to the downstream side in cooperation of the feed roller 8 with the idler roller 9 (S27). When the cut-off sheet 3 reaches the point X, the thermal head 10 is electrified and performs printing on the cut-off sheets 3 sequentially (S28). During the printing, the thermal head 10 is driven to be in a temperature range of about 300° C. to 500° C.

The printed cut-off sheet 3 is transported to the downstream side by the platen roller 11, then, passes through the cutter 12, and is discharged from the discharge slit 15 to the outside of the printer 1 in cooperation of the discharge roller 13 with the discharge idler roller 14 (S29). The process ends (S30).

The received print data is checked to determine whether or not the printing target instruction is included therein (S22). When a printing target instruction is included (Y in S22), the printing is performed in accordance with the printing target instruction. When the printing target instruction designates the cut-off sheet holder 2 as a printing target (Y in S31), the delivery roller 4 is caused to rotate and to pick up the uppermost cut-off sheet 3 (S25), and the cut-off sheet 3 is transported through the first paper transport path 7. The subsequent process is the same as described above and thus a description thereof is omitted.

When a printing target instruction is included and the cut-off sheet holder 2 is not designated as the printing target (N in S31), the printer 1 performs printing on the roll paper 21. While the printing is performed on the roll paper 21, the controller 50 determines whether the decoloring ribbon 18 unwound from the ribbon unwinding roller 16 is stretched over to the ribbon collecting roller 17 through the ribbon tension roller 19 and the point X where the thermal head 10 is in contact with the platen roller 11. When the decoloring ribbon is in a state of passing through the point X, the controller 50 causes the state to be maintained, and in a case of ribbon retraction state by the ribbon retracting mechanism, the controller 50 sets the decoloring ribbon 18 to pass through the point X (S32). Then, the print data is analyzed in the data analyzing portion 90 provided in the ROM 53 (S33) and an extent to which the decolorable printing layer may be provided is determined. After the determination of the extent of the decolorable printing layer, the feed roller 25 is caused to rotate and, in cooperation with the idler roller 26, to transport the roll paper 21 to the downstream side through the second paper transport path 24 (S34). The roll paper 21 is transported to the downstream side through the second paper transport path 24, and eventually through the first paper transport path 7 at the joining section 28. The roll paper 21 passes through the idler roller 27 and is transported further towards the downstream side, and eventually the leading end thereof reaches the point X.

Then, the controller 50 causes the roll paper 21 to be transported and the thermal head 10 to be heated, and causes the decoloring ribbon 18 to be transferred to the roll paper 21 in accordance with a result obtained by analysis of the data analyzing portion 90 (S35), and thus a decolorable layer is formed on the roll paper 21. During the transfer, the thermal head 10 is driven to be in a temperature range of about 300° C. to 500° C.

Then, the controller 50 causes the roll paper 21 to travel reversely through first paper transport path 7 until the leading end of the decolorable layer on the roll paper 21 arrives to the upstream side in a transport direction from the point X (S36).

Then, the decoloring ribbon 18 is retracted (S37) such that the decoloring ribbon 18 unwound from the ribbon unwinding roller 16 is stretched over to the ribbon collecting roller 17 only through the ribbon tension roller 19 by the ribbon retracting mechanism (not illustrated).

The roll paper 21 is transported again to the downstream side in the transport direction (S38), the thermal head 10 is heated, and the printing is performed on the decolorable layer (S39). During the printing, the thermal head 10 is driven to be in a temperature range of about 300° C. to 500° C. After the printing is completed, the roll paper 21 is cut off by the cutter 12 (S40) and the cut-off sheet is discharged from the discharge slit 15 to the outside of the printer 1 in cooperation of the discharge roller 13 with the discharge idler roller 14 (S41). The process ends (S42).

When there is no printing target instruction in the transmitted print data (N in S22), the data is analyzed in the data analyzing portion 90 (S23). A position to be printed is determined by the analysis in the data analyzing portion 90, and it is determined whether the printing should be performed on the cut-off sheet 3 to which the decolorable printing layer is provided on the entire surface thereof in advance or on the decolorable printing layer that is provided on the roll paper 21.

When, based on the data analysis, it is determined that the printing should not be performed on the cut-off sheet 3 to which the decolorable printing layer is provided on the entire surface thereof in advance, but on the decolorable layer provided on the roll paper 21, that is, the sheet feeding from the cut-off sheet holder 2 should not be performed (N in S24), the roll paper 21 is transported to the downstream side through the second paper transport path 24 (S34) and eventually through the first paper transport path 7 at the joining section 28. The subsequent process is the same as described above and thus a description thereof is omitted.

The cut-off sheets 3 which are stacked and held in the cut-off sheet holder 2 are described as sheets from which printed images are erased in advance. However, if sheets from which printed images are not erased in advance are stacked, the thermal head 10 may perform heating on the decolorable printing layer in order to perform erasing before printing, the sheet may be caused to travel reversely after the erasing is completed, and then, printing may be performed after the sheet is transported to the downstream side again. During the erasing, the thermal head 10 is driven to be in a temperature range of about 150° C. to 200° C.

As described above, according to the second embodiment, the data analyzing portion 90 that analyzes the transmitted print data is provided. When the printing is performed on the roll paper 21, the decoloring ribbon 18 is transferred to the roll paper 21 in accordance with the analysis result and the roll paper 21 is used as the decolorable paper. In addition, the user may use a recycled printing medium of any sizes for printing, and may use the printing medium cost-effectively, as compared with use of paper to which the decolorable layer is provided on the entire surface thereof in advance.

Figure 10:
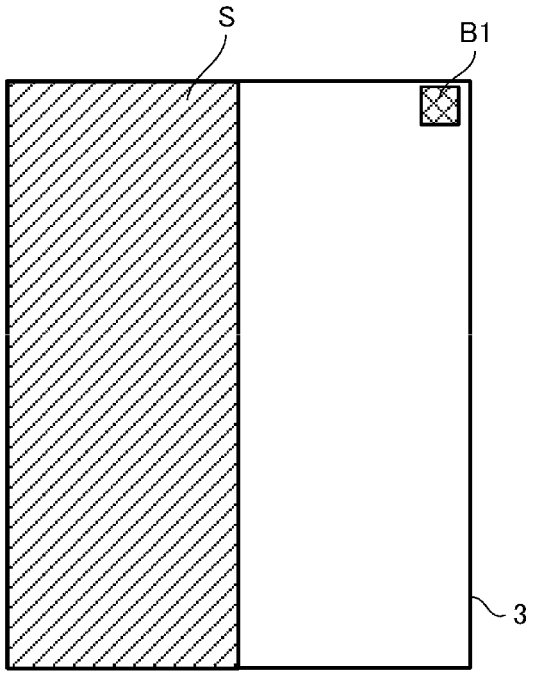
FIGS. 10-12 each illustrate an example of a cut-off sheet on which a black mark is formed.

A rotation detecting sensor (not illustrated) is provided in the ribbon unwinding roller 16 or the ribbon collecting roller 17 and detects the position of the decoloring ribbon 18 where the transfer is performed and an extent of the performed transfer, whereby it is possible to utilize the decoloring ribbon 18 effectively. For example, in accordance with the result analyzed in the data analyzing portion 90, when the decoloring ribbon 18 is transferred only on the left half of the sheet as illustrated in FIG. 10 (described below), the portion of the decoloring ribbon 18 is wasted, even though the portion of the decoloring ribbon 18 may be used to form a decolorable layer on the right half of the sheet. However, when the rotation detecting sensor (not illustrated) is provided in the ribbon unwinding roller 16 or the ribbon collecting roller 17 and detects the position of the decoloring ribbon 18 where the transfer is performed and an extent of the performed transfer, and the result analyzed in the data analyzing portion 90 means that the decoloring ribbon 18 should be transferred only on the right half of the sheet, the decoloring ribbon 18 may be rewound to a portion where the decoloring ribbon 18 is transferred only on the left half of the sheet previously. Accordingly, it is possible to reduce waste of the decoloring ribbon 18.

Third Embodiment

Hereinafter, a printer 1 according to a third embodiment is described in detail with reference to FIGS. 7 to 12. Detailed descriptions of the same components as those of the second embodiment are omitted.

Figure 8:
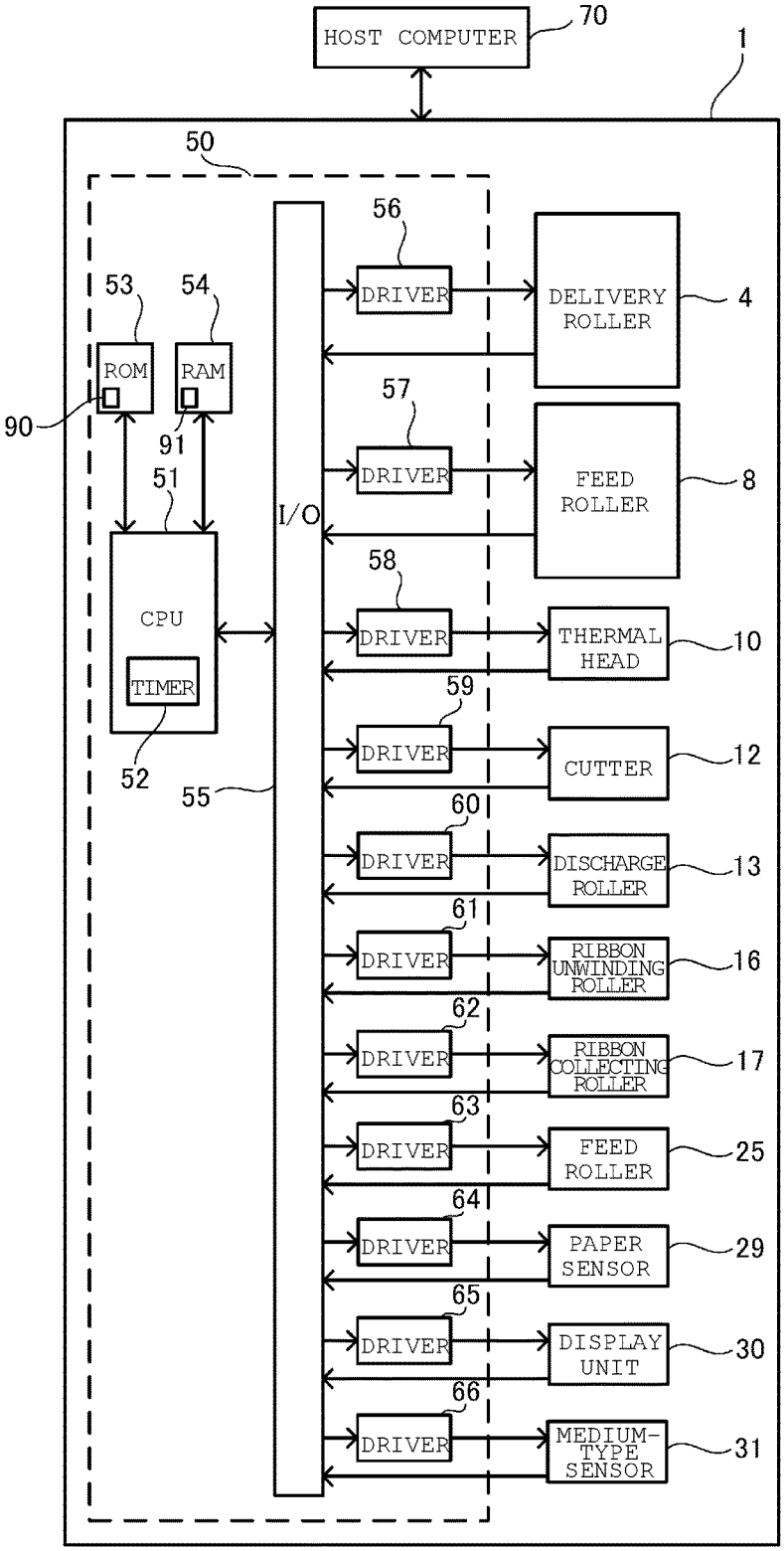
FIG. 8 is a block diagram of a printer according to a third embodiment.

In addition to the components of the second embodiment, according to the third embodiment, a medium-type sensor 31 that detects a black mark (described below) formed on the cut-off sheet 3 is provided along the first paper transport path 7 and a medium data portion 91 that stores the types of media is provided in the RAM 54 (FIG. 8). In addition, an eleventh driver 66 as a unit for extracting control outputs is connected to the I/O 55 of the controller 50. The eleventh driver 66 supplies a drive output to the medium-type sensor 31. A medium-type grasping unit includes the medium data portion 91 and the medium-type sensor 31. The medium-type sensor 31 may be provided at any position between the delivery roller 4 and the point X.

Figure 9:
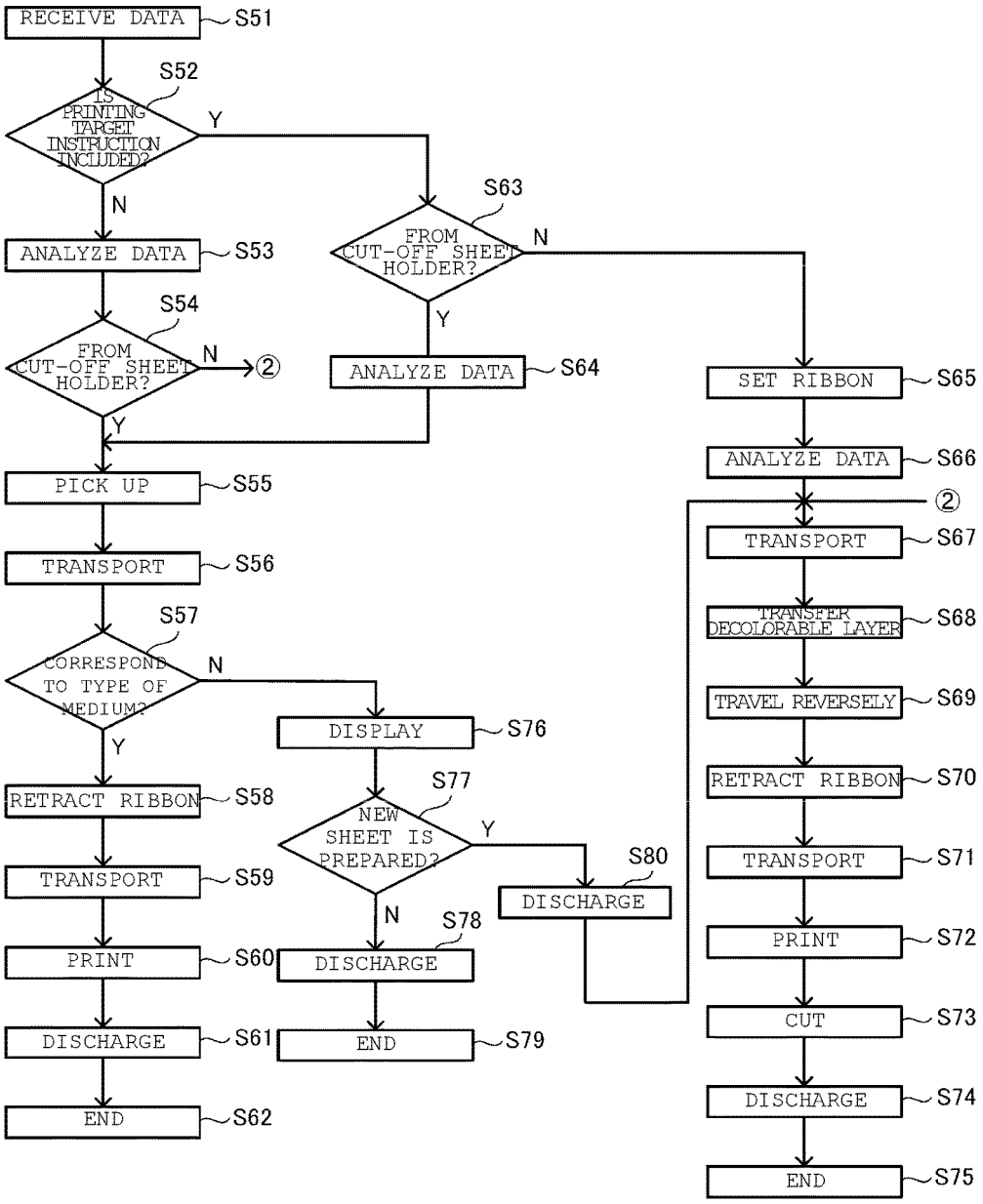
FIG. 9 is a flowchart illustrating a printing process carried out by the printer according to the third embodiment.

Hereinafter, operations of the printer 1 according to the third embodiment are described with reference to FIG. 9.

When print data is received from the host computer 70 (S51), the printer 1 determines whether or not a printing target instruction is included in the transmitted print data. Since the printer 1 according to the third embodiment includes the cut-off sheet holder 2 and the roll paper 21, the printing target instruction in this case includes designation of one of the cut-off sheet holder 2 and the roll paper 21 or automatic determination.

The received print data is checked to determine whether or not the printing target instruction is included therein (S52). When there is no printing target instruction (N in S52), the print data is analyzed in the data analyzing portion 90 (S53). Here, it is determined whether the printing should be performed on the cut-off sheet 3 to which the decolorable printing layer is provided on the entire surface thereof in advance or on the decolorable printing layer formed on the roll paper 21. At this time, an optimal position or size of the decolorable printing layer is also determined.

When, based on the data analysis, it is determined that sheet feeding from the cut-off sheet holder 2 should be performed (Y in S54), the delivery roller 4 is caused to rotate and to pick up the uppermost cut-off sheet 3 (S55), and the cut-off sheet 3 is transported through the first paper transport path 7 (S56).

Figure 11:
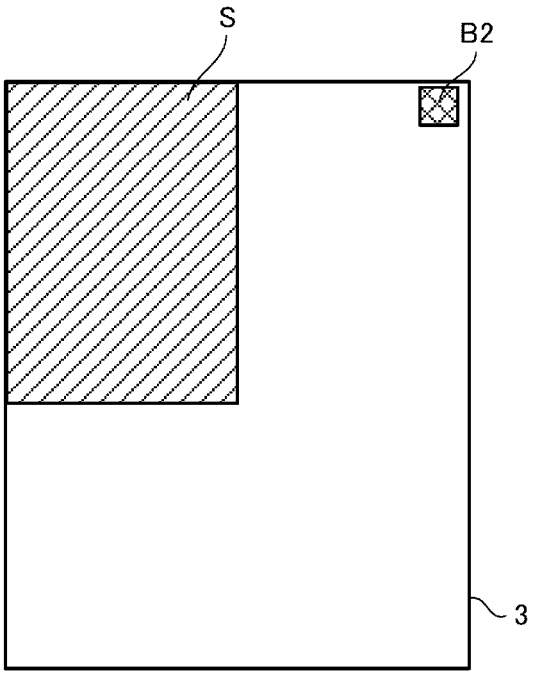
Figures 12, 13:
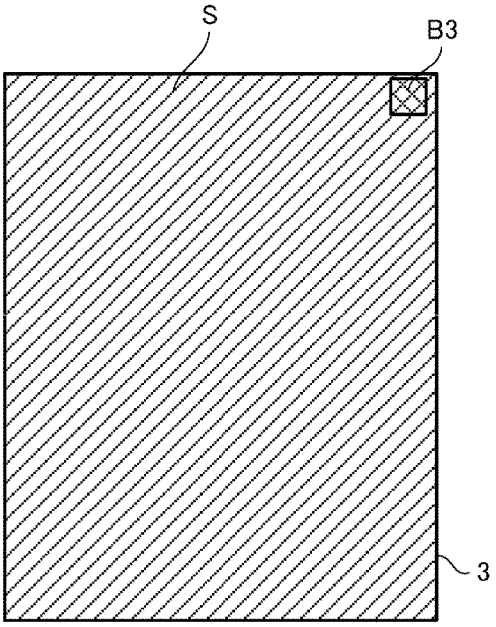
FIG. 13 illustrates a table listing types of cut-off sheets.

Each of the cut-off sheets 3 which are stacked and held in the cut-off sheet holder 2 have a black mark B. In a description of the embodiment, three types of cut-off sheets 3 are provided: (i) a sheet on which a colorable/decolorable printing layer S is formed on an entire left half thereof as illustrated in FIG. 10; (ii) a sheet on which a colorable/decolorable printing layer S is formed on an upper half of a left half thereof as illustrated in FIG. 11; and (iii) a sheet on which a colorable/decolorable printing layer S is formed on an entire surface thereof as illustrated in FIG. 12. The paper size of any cut-off sheets 3 is A4, each has one of different black marks B1-B3. Also, as illustrated in FIG. 13, data of these black marks B1-B3 are stored in the medium data portion 91.

In the printer 1, the medium-type sensor 31 is provided along the first paper transport path 7. The medium-type sensor 31 detects the black marks B provided on the cut-off sheets 3 and which of black marks B1 to B3 is formed on the medium is determined. Then, the determined type of medium is compared with the result obtained through the data analysis in the data analyzing portion 90 (S53), and it is determined whether or not the print data corresponds to the type of medium (S57). Here, whether or not the print data corresponds to the type of medium is determined as follows. For example, when an analysis result indicating that images to be printed extends from the left end to the right end of the sheet is obtained and the type of medium transported has the black mark B1 or black mark B2, the printing is not performed. Therefore, here, the print data is determined not to correspond to the type of medium. In addition, when type of the medium is the cut-off sheet 3 having the black mark B1 or the black mark B3 is transported and printing can be performed even with the sheet having the black mark B2, the print data is determined to not correspond to the type of medium because the colorable/decolorable printing layer S is formed on an unnecessary region and thus the sheet is not the optimal type of cut-off sheet 3.

When the print data corresponds to the type of medium (Y in S57), the decoloring ribbon 18 unwound from the ribbon unwinding roller 16 is stretched over to the ribbon collecting roller 17 only through the ribbon tension roller 19 by the ribbon retracting mechanism (not illustrated), that is, the decoloring ribbon 18 is retracted from the point X which is the transferring position of the decoloring ribbon 18 (S58). Then, the controller 50 operates to transport the picked-up cut-off sheet 3 to the downstream side in cooperation of the feed roller 8 with the idler roller 9 (S59). When the cut-off sheet 3 reaches the point X, the thermal head 10 is electrified and performs printing on the cut-off sheets 3 sequentially (S60). During the printing, the thermal head 10 is driven to be in a temperature range of about 300° C. to 500° C.

The printed cut-off sheet 3 is transported to the downstream side by the platen roller 11, then passes through the cutter 12, and is discharged from the discharge slit 15 to the outside of the printer 1 in cooperation of the discharge roller 13 with the discharge idler roller 14 (S61). The process ends (S62).

The printing target instruction included in the transmitted print data is checked to determine whether or not the printing target instruction is included (S52). When a printing target instruction is included (Y in S52), the printing is performed in accordance with the printing target instruction. However, the user may designate a wrong printing target. Therefore, the print data is analyzed in the data analyzing portion 90 (S64), and information indicating which is an optimal cut-off sheet 3 is acquired.

Since the printing target instruction designates the cut-off sheet holder 2, the delivery roller 4 is caused to rotate and to pick up the uppermost cut-off sheet 3 (S55), and the cut-off sheet 3 is transported through the first paper transport path 7. The subsequent process is the same as described above and thus a description thereof is omitted.

When a printing target instruction is included and the cut-off sheet holder 2 is not designated (N in S63), the printer 1 performs printing on the roll paper 21. While the printing is performed on the roll paper 21, the controller 50 determines whether or not the decoloring ribbon 18 unwound from the ribbon unwinding roller 16 is stretched over to the ribbon collecting roller 17 through the ribbon tension roller 19 and the point X where the thermal head 10 is in contact with the platen roller 11. When the decoloring ribbon 18 is in a state of passing through the point X, the controller 50 causes the state to be maintained. On the other hand, when the decoloring ribbon 18 is in the ribbon retraction state, the controller 50 controls the ribbon retracting mechanism so that the decoloring ribbon 18 passes through the point X (S65). Then, the print data is analyzed in the data analyzing portion 90 provided in the ROM 53 (S66) and an extent to which the decolorable printing layer is formed is determined. After the determination of the extent of the decolorable printing layer, the feed roller 25 is caused to rotate and, in cooperation with the idler roller 26, to transport the roll paper 21 to the downstream side through the second paper transport path 24 (S67). The roll paper 21 is transported to the downstream side through the second paper transport path 24, and eventually, is conveyed to the first paper transport path 7 at the joining section 28. The roll paper 21 passes through the idler roller 27 and is transported further to the downstream side, and eventually the leading end thereof reaches the point X.

Then, the controller 50 causes the roll paper 21 to be transported and the thermal head 10 to be heated, and causes the decoloring ribbon 18 to be transferred to the roll paper 21 in accordance with a result obtained thorough the analysis at the data analyzing portion 90 (S68), and thus a decolorable layer is formed on the roll paper 21. During the transfer, the thermal head 10 is driven to be in a temperature range of about 300° C. to 500° C.

Then, the controller 50 causes the roll paper 21 to travel reversely through first paper transport path 7 until the leading end of the decolorable layer on the roll paper 21 arrives at the upstream side in the transport direction from the point X (S69).

Then, the decoloring ribbon 18 is retracted (S70) such that the decoloring ribbon 18 unwound from the ribbon unwinding roller 16 is stretched over to the ribbon collecting roller 17 only through the ribbon tension roller 19 by the ribbon retracting mechanism (not illustrated).

The roll paper 21 is transported again to the downstream side in the transport direction (S71), the thermal head 10 is heated, and the printing is performed on the decolorable layer (S72). During the printing, the thermal head 10 is driven to be in a temperature range of about 300° C. to 500° C. After the printing is completed, the roll paper 21 is cut by the cutter 12 (S73) and the cut-off sheet is discharged from the discharge slit 15 to the outside of the printer 1 in cooperation of the discharge roller 13 with the discharge idler roller 14 (S74). The process ends (S75).

When no printing target instruction is included in the received print data (N in S52), the print data is analyzed in the data analyzing portion 90 (S53). A position to be printed is determined through the analysis in the data analyzing portion 90, and it is determined whether the printing should be performed on the cut-off sheet 3 to which the decolorable printing layer is provided on the entire surface thereof or on the decolorable printing layer formed on the roll paper 21.

When, based on the data analysis, it is determined that the printing should not be performed on the cut-off sheet 3 to which the decolorable printing layer is formed on the entire surface thereof in advance, but on the decolorable layer formed on the roll paper 21, that is, the sheet feeding from the cut-off sheet holder 2 should not be performed (N in S54), the roll paper 21 is transported to the downstream side through the second paper transport path 24 (S67), and eventually, is conveyed to the first paper transport path 7 at the joining section 28. The subsequent process is the same as described above and thus a description thereof is omitted.

The medium-type sensor 31 is provided on the first paper transport path 7. The medium-type sensor 31 detects the black marks B formed on the cut-off sheets 3, and which of black marks B1 to B3 is formed on a medium is determined. Then, the determined type of medium is compared with the result obtained through the data analysis in the data analyzing portion 90 (S53). Here, whether or not the print data corresponds to the type of medium is determined (S57). When the print data does not correspond to the type of medium (N in S37), an indication that the cut-off sheet 3 is not correct is displayed on the display unit 30 (S76). Then, an inquiry of whether a cut-off sheet 3 having a decolorable printing layer should be prepared using a new sheet from the roll paper 21 to perform printing is presented to the user (S77). The user determines whether to prepare the new sheet through a button (not illustrated) or the like. When it is determined that a new sheet is not prepared (N in S77), the cut-off sheet 3 present on the first paper transport path 7 is discharged to the outside of the printer 1 (S78) and the process ends (S79).

When it is determined that a new sheet is prepared (Y in S77), the cut-off sheet 3 present on the first paper transport path 7 is discharged to the outside of the printer (S80). The feed roller 25 is caused to rotate and, in cooperation with the idler roller 26, to transport the roll paper 21 to the downstream side through the second paper transport path 24 (S67). The subsequent process is the same as described above and thus a description thereof is omitted.

The cut-off sheet 3 on which the black mark B is formed has the colorable/decolorable printing layer S at least on a portion where the black mark B is printed.

The cut-off sheets 3 which are stacked and held in the cut-off sheet holder 2 are described as sheets from which printed images are erased in advance. However, if sheets from which printed images are not erased in advance are stacked, the thermal head 10 may perform heating on the decolorable printing layer except for the portion of the black mark B in order to perform erasing before printing, the sheet may be caused to travel reversely after complete erasing, and then, printing may be performed after the sheet is transported to the downstream side again. Alternatively, the thermal head 10 may perform heating on the decolorable printing layer including the portion of the black mark B, the sheet may be caused to travel reversely after complete erasing, and then, the printing and the printing of the corresponding the black mark B may be performed after the sheet is transported to the downstream side again. At this time, during the printing, the thermal head 10 is driven to be in a temperature range of about 300° C. to 500° C. During the erasing, the thermal head 10 is driven to be in a temperature range of about 150° C. to 300° C.

According to the embodiment, three types of media are used as illustrated in FIG. 13, but the number of the media types is not limited thereto. Five types or ten types may be stored in advance. In addition, when an analysis result indicating that it is desired to use a pattern other than the stored patterns is obtained through an analysis at the data analyzing portion 90, in addition to the stored patterns in advance, a new paper pattern may be added.

As described above, according to the third embodiment, the medium-type detecting unit that detects the types of cut-off sheets 3 which are stacked and held in the cut-off sheet holder 2 is provided. Accordingly, even when the cut-off sheet 3 prepared using the roll paper 21 enters the cut-off sheet holder 2 and is reused, the printing is not performed on an inappropriate cut-off sheet 3. Therefore, it is possible to prevent the printing from being performed wastefully.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a sheet conveyer configured to unwind a portion of a rolled sheet and convey the unwound sheet;

a ribbon conveyer configured to convey a ribbon having thereon a coloring layer that is not colored up to a predetermined temperature and becomes colored above the predetermined temperature;

a thermal head configured to transfer the coloring layer on the ribbon to a portion of the unwound sheet and form an image based on print data using the coloring layer that has been transferred to the portion of the unwound sheet; and a cutter configured to cut off a portion of the unwound sheet on which the image is formed, wherein the ribbon conveyer includes a first roller around which a portion of the ribbon that has not passed the thermal head is wound, and a second roller around which a portion of the ribbon that has passed the thermal head is wound.

2. The sheet processing apparatus according to claim 1, wherein the thermal head heats the coloring layer to a temperature above the predetermined temperature while forming the image based on the print data.

3. The sheet processing apparatus according to claim 1, wherein the sheet conveyer is further configured to rewind the unwound sheet after the coloring layer has been transferred to the portion of the unwound sheet, and convey the rewound sheet to the thermal head for forming the image.

4. The sheet processing apparatus according to claim 1, wherein the thermal head transfers the coloring layer to the portion of the unwound sheet, such that a length of the transferred coloring layer corresponds to a length of the image to be formed based on the print data.

5. The sheet processing apparatus according to claim 1, wherein the thermal head transfers the coloring layer to the portion of the unwound sheet, such that a width of the transferred coloring layer corresponds to a width of the image to be formed based on the print data.

6. The sheet processing apparatus according to claim 1, further comprising:

a sheet storage in which a sheet cut off by the cutter is stored.

7. The sheet processing apparatus according to claim 1, further comprising:

a moving module configured to move the ribbon in a width direction of the ribbon after the coloring layer has been transferred to the portion of the unwound sheet and before the image is formed.

8. The sheet processing apparatus according to claim 1, wherein the thermal head heats up to a temperature below the predetermined temperature when carrying out erasure of an image.

9. The sheet processing apparatus according to claim 1, wherein the image becomes decolored when heated up to a temperature below the predetermined temperature.

* * * * *